US011333149B2

(12) United States Patent
Inoue et al.

(10) Patent No.: US 11,333,149 B2
(45) Date of Patent: May 17, 2022

(54) ROTARY COMPRESSOR

(71) Applicant: FUJITSU GENERAL LIMITED, Kanagawa (JP)

(72) Inventors: Akira Inoue, Kanagawa (JP); Junya Tanaka, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 162 days.

(21) Appl. No.: 16/635,257

(22) PCT Filed: Jul. 25, 2018

(86) PCT No.: PCT/JP2018/027968
§ 371 (c)(1),
(2) Date: Jan. 30, 2020

(87) PCT Pub. No.: WO2019/039181
PCT Pub. Date: Feb. 28, 2019

(65) Prior Publication Data

US 2021/0095670 A1 Apr. 1, 2021

(30) Foreign Application Priority Data

Aug. 24, 2017 (JP) ..... JP2017-161575

(51) Int. Cl.
*F04C 18/356* (2006.01)
*F04C 23/02* (2006.01)
*F04C 18/332* (2006.01)

(52) U.S. Cl.
CPC ..... *F04C 18/356* (2013.01); *F04C 23/02* (2013.01)

(58) Field of Classification Search
CPC .. F04C 18/356; F04C 18/332; F04C 18/3584; F04C 23/02
See application file for complete search history.

(56) References Cited

U.S. PATENT DOCUMENTS 9,879,675 B2 1/2018 Takashima et al.
10,309,399 B2 * 6/2019 Inoue ..... F04C 18/332
(Continued)

FOREIGN PATENT DOCUMENTS

CN 201144809 Y 11/2008
CN 106762648 A 5/2017
(Continued)

OTHER PUBLICATIONS

Apr. 26, 2021, Chinese Office Action issued for related CN application No. 201880052880.3.

*Primary Examiner* — Deming Wan
(74) *Attorney, Agent, or Firm* — Paratus Law Group, PLLC

(57) ABSTRACT

A recessed part is provided in a position, in which an upper vane and a lower vane slide, in an outer peripheral part of an intermediate partition plate in a rotary compressor. Double of eccentric amounts in an upper eccentric part and a lower eccentric part of a rotating shaft is 30% or more of entire lengths in a sliding direction of the upper vane and the lower vane respectively. A width W of the recessed part in a circumferential direction of the intermediate partition plate is larger than a thickness T of each of the upper vane and the lower vane. When a depth of the recessed part is D and an entire length of each of the upper vane and the lower vane is L, D≥0.1×L . . . Expression 1 is satisfied.

7 Claims, 7 Drawing Sheets

(56) References Cited

U.S. PATENT DOCUMENTS

| | | | | |
|---|---|---|---|---|
| 10,458,408 | B2 * | 10/2019 | Morozumi | F04C 29/128 |
| 2014/0314607 | A1 * | 10/2014 | Maeyama | F04C 18/3564 418/63 |
| 2016/0356272 | A1 * | 12/2016 | Higuchi | F04C 29/0057 |
| 2017/0248139 | A1 * | 8/2017 | Furuya | F04C 29/0085 |

FOREIGN PATENT DOCUMENTS

| | | | |
|---|---|---|---|
| CN | 107061275 | A | 8/2017 |
| JP | S61-204989 | U | 12/1986 |
| JP | H05-149281 | A | 6/1993 |
| JP | 2003-097467 | A | 4/2003 |
| JP | 2012-251474 | A | 12/2012 |
| JP | 2016-160916 | A | 9/2016 |
| JP | 2017-002734 | A | 1/2017 |
| WO | WO 2014/025025 | A1 | 2/2014 |

* cited by examiner

ROTARY COMPRESSOR

CROSS REFERENCE TO PRIOR APPLICATION

This application is a National Stage Patent Application of PCT International Patent Application No. PCT/JP2018/027968 (filed on Jul. 25, 2018) under 35 U.S.C. § 371, which claims priority to Japanese Patent Application No. 2017-161575 (filed on Aug. 24, 2017), which are all hereby incorporated by reference in their entirety.

FIELD

The present invention relates to a rotary compressor.

BACKGROUND

In a rotary compressor, an annular piston provided eccentrically with respect to a rotating shaft rotates in a cylinder, and a leading end of a plate-shaped vane that reciprocates in the cylinder along with the rotation of the piston is pressure-welded to an outer peripheral surface of the piston. Thus, the inside of the cylinder is separated into a compression chamber and a suction chamber. In a two-cylinder type rotary compressor, a vane slides in a vane groove of a cylinder, which is sandwiched by an end plate and an intermediate partition plate, in a state of being biased by a spring.

In a rotary compressor of this kind, a rotating shaft is deflected only for a little in an axial direction when refrigerant gas is compressed by a piston in a cylinder. The piston is inclined in a direction orthogonal to the rotating shaft along with the deflection of the rotating shaft, and a vane is inclined in a sliding direction for an amount of a clearance between the vane and a vane groove in a vertical direction of the rotary compressor (axial direction of rotating shaft). Thus, a contact state between a leading end of the vane and an outer peripheral surface of the piston varies, and the leading end of the vane that slides in a state of being held in the vane groove is brought into a state of being partially in contact with the outer peripheral surface of the piston. Here, a surface pressure at the leading end of the vane is locally increased in the axial direction of the rotating shaft, and there is a possibility that abrasion or breakage of the vane, piston, or the like is generated.

As a rotary compressor in a related art, in order to control partial contact of a vane with a piston, a configuration in which the vane is divided into two in an axial direction of a rotating shaft and leading ends of the two vanes lined up in the axial direction of the rotating shaft are made to contact with an outer peripheral surface of the piston has been known. In this configuration, an inclination is distributed to the two vanes and a partial contact state between the piston and the vane is reduced.

CITATION LIST

Patent Literature

Patent Literature 1: WO 2014/025025

SUMMARY

Technical Problem

However, in the above-described rotary compressor in a related art, a vane is divided into two and sliding resistance is generated between the vanes. Thus, there is an influence on a sliding property of the vanes as a whole and operation reliability of the whole vanes is decreased. Also, since a spring is arranged for each of the two divided vanes, a structure becomes complicated and a production cost is increased.

A disclosed technology is provided in view of the forgoing, and is to provide a rotary compressor capable of controlling partial contact of a vane with a piston and improving operation reliability of the vane.

Solution to Problem

To solve the above problem and attain the object, a rotary compressor disclosed in this application, according to an aspect, includes: a vertically-cylindrical compressor housing in an upper part of which a discharge portion for a refrigerant is provided and in a lower part of which a suction portion for the refrigerant is provided; a compressing unit that is arranged in the lower part in the compressor housing, that compresses the refrigerant sucked from the suction portion, and that performs a discharge thereof from the discharge portion; and a motor that is arranged in the upper part in the compressor housing and that drives the compressing unit, wherein the compressing unit includes an annular upper cylinder and an annular lower cylinder, an upper end plate that blocks an upper side of the upper cylinder, a lower end plate that blocks a lower side of the lower cylinder, an intermediate partition plate that is arranged between the upper cylinder and the lower cylinder and that blocks a lower side of the upper cylinder and an upper side of the lower cylinder, a rotating shaft rotated by the motor, an upper eccentric part and a lower eccentric part that are provided to the rotating shaft with 180° of a phase difference from each other, an upper piston that is fitted into the upper eccentric part, that makes an orbit motion along an inner peripheral surface of the upper cylinder, and that forms an upper cylinder chamber in the upper cylinder, a lower piston that is fitted into the lower eccentric part, that makes an orbit motion along an inner peripheral surface of the lower cylinder, and that forms a lower cylinder chamber in the lower cylinder, an upper vane that separates the upper cylinder chamber into an upper suction chamber and an upper compression chamber by being protruded from an upper vane groove provided in the upper cylinder into the upper cylinder chamber and coming into contact with the upper piston, and a lower vane that separates the lower cylinder chamber into a lower suction chamber and a lower compression chamber by being protruded from a lower vane groove provided in the lower cylinder into the lower cylinder chamber and coming into contact with the lower piston, a recessed part is provided in a position, in which the upper vane and the lower vane slide, in an outer peripheral part of the intermediate partition plate, double of eccentric amounts of the upper eccentric part and the lower eccentric part of the rotating shaft is 30% or more of entire lengths in a sliding direction of the upper vane and the lower vane respectively, and a width W of the recessed part in a circumferential direction of the intermediate partition plate is larger than a thickness T of each of the upper vane and the lower vane, and when a depth of the recessed part is D and the entire length of each of the upper vane and the lower vane is L, $D \geq 0.1 \times L$ . . . Expression 1 is satisfied.

Advantageous Effects of Invention

According to an aspect of a rotary compressor disclosed in the present application, it is possible to control partial contact of a vane with a piston, and to improve operation reliability of the vane.

DESCRIPTION OF EMBODIMENTS

In the following, embodiments of a rotary compressor disclosed in the present application will be described in detail on the basis of the drawings. Note that the rotary compressor disclosed in the present application is not limited by the following embodiments.

Embodiment (Configuration of Rotary Compressor)

Figure 1:
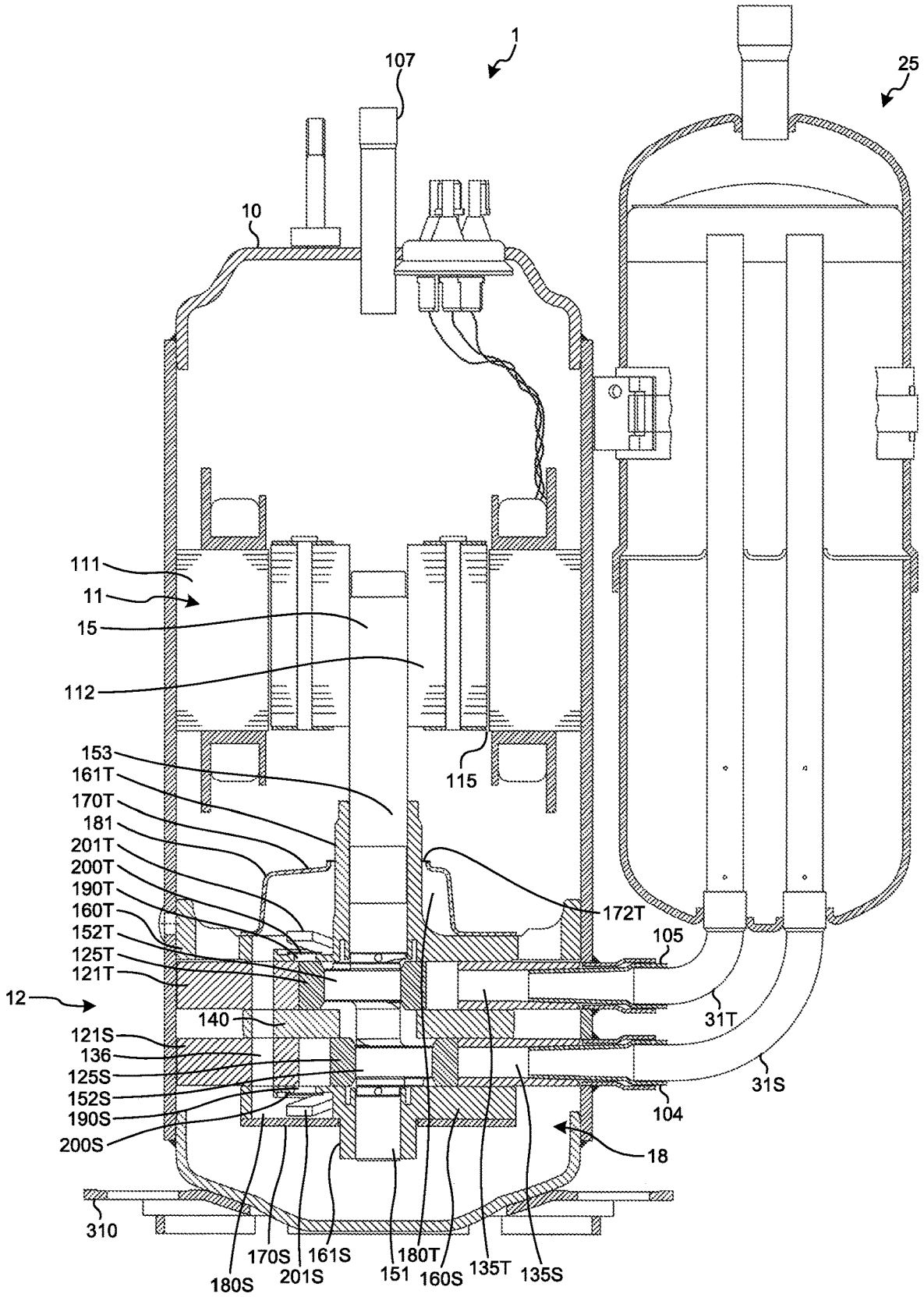
FIG. 1 is a longitudinal sectional view illustrating a rotary compressor of an embodiment.
Figure 2:
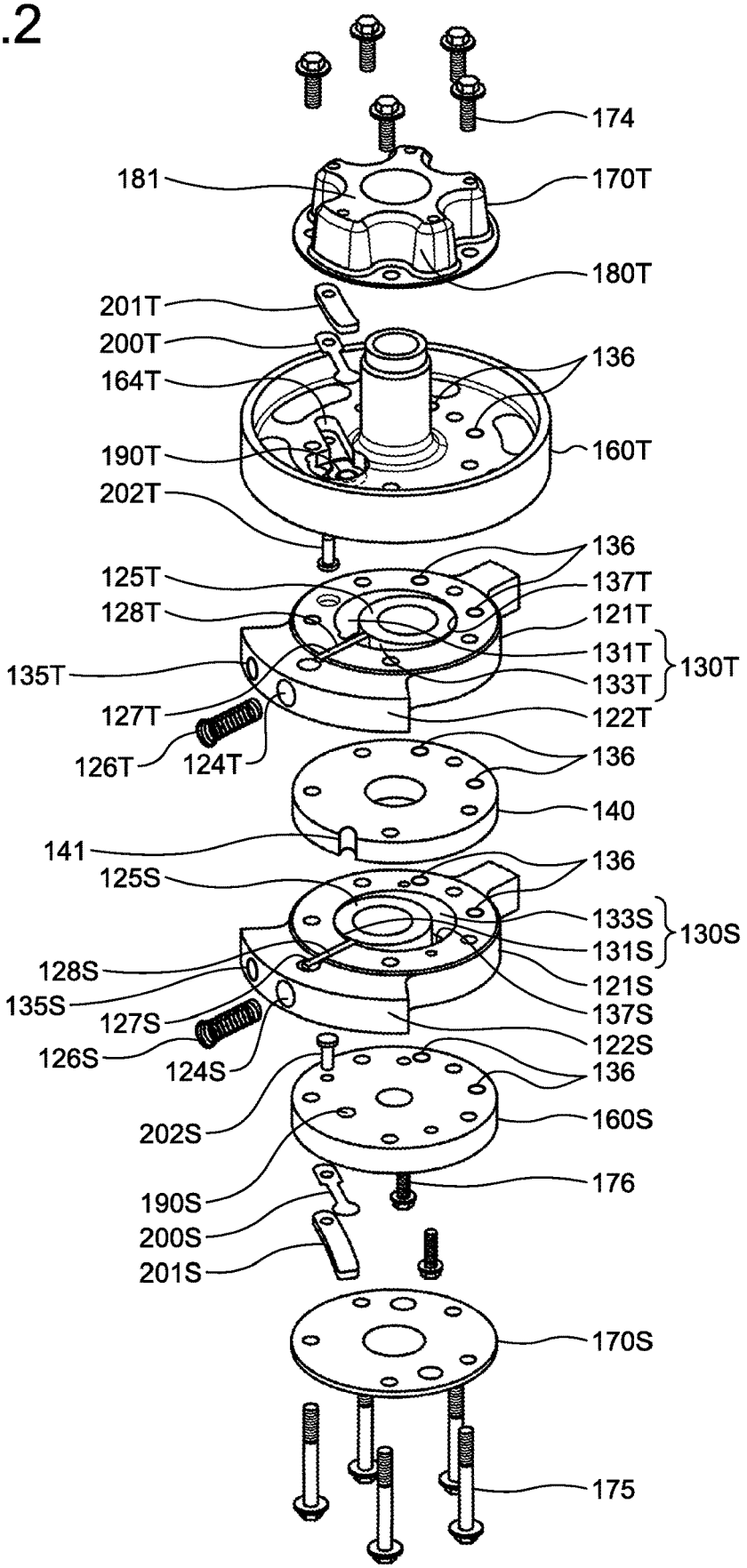
FIG. 2 is an exploded perspective view illustrating a compressing unit of the rotary compressor of the embodiment.
Figure 3:
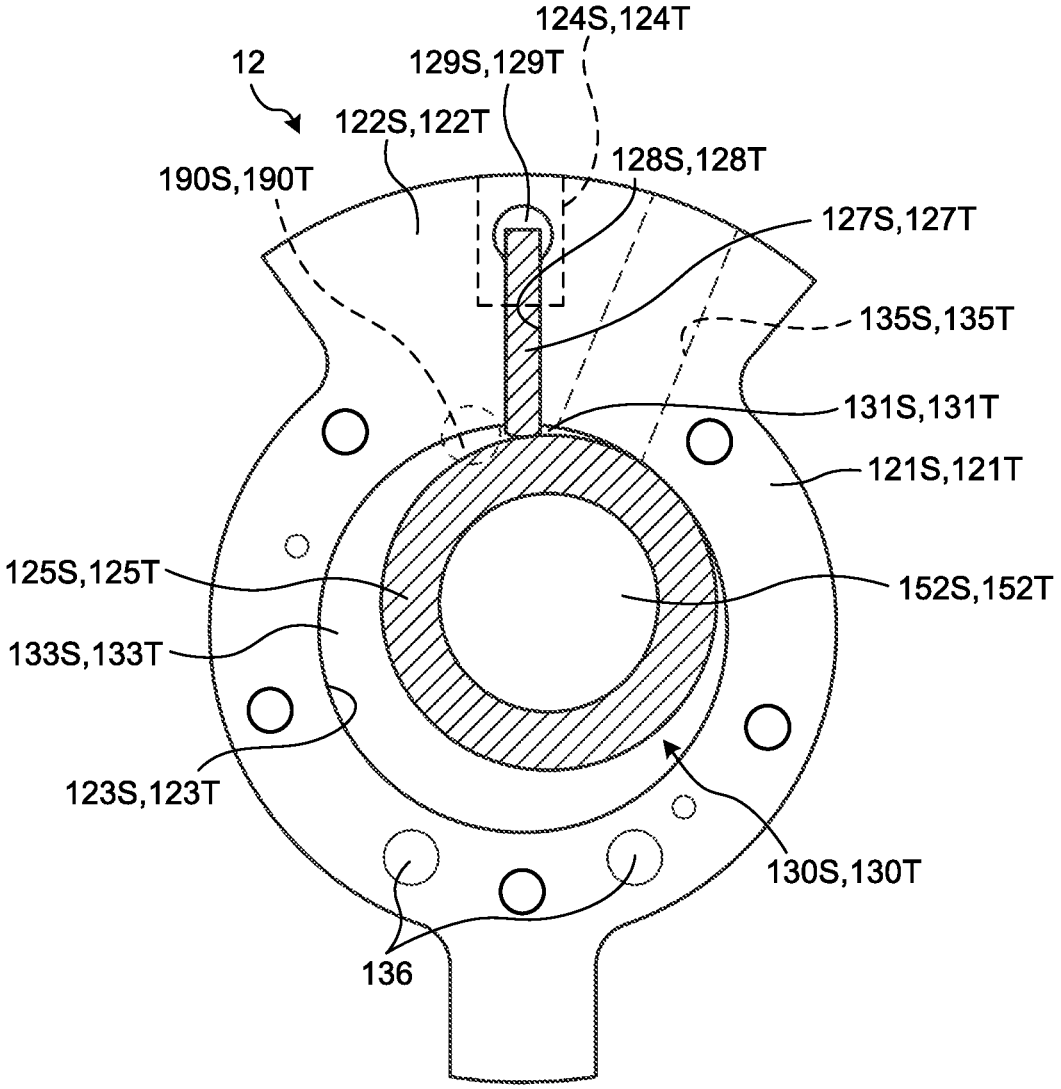
FIG. 3 is a transverse sectional view illustrating the compressing unit of the rotary compressor of the embodiment from the above.

FIG. 1 is a longitudinal sectional view illustrating a rotary compressor of an embodiment. FIG. 2 is an exploded perspective view illustrating a compressing unit of the rotary compressor of the embodiment. FIG. 3 is a transverse sectional view illustrating the compressing unit of the rotary compressor of the embodiment from the above.

As illustrated in FIG. 1, a rotary compressor 1 includes a compressing unit 12 arranged in a lower part in a sealed vertically-cylindrical compressor housing 10, a motor 11 that is arranged in an upper part in the compressor housing 10 and that drives the compressing unit 12 through a rotating shaft 15, and a vertically-cylindrical accumulator 25 fixed to an outer peripheral surface of the compressor housing 10.

The compressor housing 10 includes an upper suction pipe 105 and a lower suction pipe 104 to suck a refrigerant, the upper suction pipe 105 and the lower suction pipe 104 being provided in a lower part of a side surface of the compressor housing 10. The accumulator 25 is connected to an upper cylinder chamber 130T (see FIG. 2) of an upper cylinder 121T through the upper suction pipe 105 and an accumulator upper L-shaped pipe 31T that are included as a suction portion, and is connected to a lower cylinder chamber 130S (see FIG. 2) of a lower cylinder 121S through the lower suction pipe 104 and an accumulator lower L-shaped pipe 31S that are included as a suction portion.

The motor 11 includes a stator 111 arranged on an outer side, and a rotor 112 arranged on an inner side. The stator 111 is fixed to an inner peripheral surface of the compressor housing 10 by shrink-fitting, and the rotor 112 is fixed to the rotating shaft 15 by shrink-fitting.

A sub-shaft part 151 on a lower side of a lower eccentric part 152S is rotatably supported by a sub bearing part 161S provided in a lower end plate 160S, a main shaft part 153 on an upper side of an upper eccentric part 152T is rotatably supported by a main baring part 161T provided in an upper end plate 160T, and an upper piston 125T and a lower piston 125S are respectively supported by the upper eccentric part 152T and the lower eccentric part 152S provided with a phase difference of 180° from each other. Thus, the rotating shaft 15 is supported rotatably with respect to the compressing unit 12 and makes, by a rotation, the upper piston 125T and the lower piston 125S respectively perform orbital motions along inner peripheral surfaces of the upper cylinder 121T and the lower cylinder 121S.

Lubricant 18 is included inside the compressor housing 10, for an amount in which most of the compressing unit 12 is immersed, in order to secure lubricity of sliding parts such as the upper piston 125T and the lower piston 125S that slide in the compressing unit 12 and to seal an upper compression chamber 133T (see FIG. 2) and a lower compression chamber 133S (see FIG. 2). An attachment leg 310 (see FIG. 1) to lock a plurality of elastic supporting members (not illustrated), which supports the whole rotary compressor 1, is fixed on a lower side of the compressor housing 10.

As illustrated in FIG. 1, the compressing unit 12 compresses a refrigerant sucked from the upper suction pipe 105 and the lower suction pipe 104, and performs discharge thereof from a discharge pipe 107 described later. As illustrated in FIG. 2, the compressing unit 12 includes, from a top, an upper end plate cover 170T having a bulged part 181 in which a hollow space is formed, an upper end plate 160T, an annular upper cylinder 121T, an intermediate partition plate 140, an annular lower cylinder 121S, a lower end plate 160S, and a tabular lower end plate cover 170S in a laminated manner. The whole compressing unit 12 is fixed by a plurality of through bolts 174 and 175 arranged vertically in a substantially concentric manner, and an auxiliary bolt 176.

As illustrated in FIG. 3, in the upper cylinder 121T, an upper cylinder inner wall 123T is formed concentrically with respect to the rotating shaft 15 of the motor 11. In the upper cylinder inner wall 123T, the upper piston 125T an outer diameter of which is smaller than an inner diameter of the upper cylinder 121T is arranged, and the upper compression chamber 133T to suck, compress, and discharge a refrigerant is formed between the upper cylinder inner wall 123T and the upper piston 125T. In the lower cylinder 121S, a lower cylinder inner wall 123S is formed concentrically with respect to the rotating shaft 15 of the motor 11. In the lower cylinder inner wall 123S, the lower piston 125S an outer diameter of which is smaller than an inner diameter of the lower cylinder 121S is arranged, and the lower compression chamber 133S to suck, compress, and discharge a refrigerant is formed between the lower cylinder inner wall 123S and the lower piston 125S.

As illustrated in FIG. 2 and FIG. 3, the upper cylinder 121T includes an upper side protrusion part 122T that is protruded from an outer peripheral part to an outer peripheral side in a radial direction of a cylindrical inner peripheral surface 137T. In the upper side protrusion part 122T, an upper vane groove 128T that is extended radially from the upper cylinder chamber 130T to an outer side is provided. An upper vane 127T is slidably arranged in the upper vane groove 128T. The lower cylinder 121S includes a lower side protrusion part 122S protruded from an outer peripheral part to an outer peripheral side in a radial direction of a cylindrical inner peripheral surface 137S. A lower vane groove 128S radially extended to an outer side from the lower cylinder chamber 130S is provided in the lower side protrusion part 122S. A lower vane 127S is slidably arranged in the lower vane groove 128S.

In the upper cylinder 121T, an upper spring hole 124T is provided, in a depth of not reaching the upper cylinder chamber 130T, in a position overlapped with the upper vane groove 128T from a lateral surface. An upper spring 126T is arranged in the upper spring hole 124T. In the lower cylinder 121S, a lower spring hole 124S is provided, in a depth of not reaching the lower cylinder chamber 130S, in a position overlapped with the lower vane groove 128S from a lateral surface. A lower spring 126S is arranged in the lower spring hole 124S.

Also, in the lower cylinder 121S, a lower pressure introduction passage 129S, which makes an outer side in a radial direction of the lower vane groove 128S and the compressor housing 10 communicate with each other through an opening part, introduces a compressed refrigerant in the compressor housing 10, and applies backpressure to the lower vane 127S with pressure of the refrigerant, is formed. Note that the compressed refrigerant in the compressor housing 10 is also introduced from the lower spring hole 124S. Also, in the upper cylinder 121T, an upper pressure introduction passage 129T, which makes an outer side in a radial direction of the upper vane groove 128T and the compressor housing 10 communicate with each other through an opening part, introduces the compressed refrigerant in the compressor housing 10, and gives backpressure to the upper vane 127T with pressure of the refrigerant, is formed. Note that the compressed refrigerant in the compressor housing 10 is also introduced from the upper spring hole 124T.

As illustrated in FIG. 3, an upper suction hole 135T, into which the upper suction pipe 105 is fitted, is provided in the upper side protrusion part 122T of the upper cylinder 121T. In the lower side protrusion part 122S of the lower cylinder 121S, a lower suction hole 135S, into which the lower suction pipe 104 is fitted, is provided.

As illustrated in FIG. 2, an upper side of the upper cylinder chamber 130T is blocked with the upper end plate 160T, and a lower side thereof is blocked with the intermediate partition plate 140. An upper side of the lower cylinder chamber 130S is blocked with the intermediate partition plate 140, and a lower side thereof is blocked with the lower end plate 160S.

As illustrated in FIG. 3, when the upper vane 127T is pressed by the upper spring 126T and comes into contact with an outer peripheral surface of the upper piston 125T, the upper cylinder chamber 130T is separated into an upper suction chamber 131T that communicates with the upper suction hole 135T, and the upper compression chamber 133T that communicates with an upper discharge hole 190T provided in the upper end plate 160T. When the lower vane 127S is pressed by the lower spring 126S and comes into contact with an outer peripheral surface of the lower piston 125S, the lower cylinder chamber 130S is separated into a lower suction chamber 131S that communicates with the lower suction hole 135S, and the lower compression chamber 133S that communicates with a lower discharge hole 190S provided in the lower end plate 160S.

As illustrated in FIG. 2, the upper discharge hole 190T, which pieces through the upper end plate 160T and communicates with the upper compression chamber 133T of the upper cylinder 121T, are provided in the upper end plate 160T, and an upper valve seat (not illustrated) is formed around the upper discharge hole 190T on an outlet side of the upper discharge hole 190T. In the upper end plate 160T, an upper discharge valve housing recessed part 164T, which is extended in a groove shape in a circumferential direction of the upper end plate 160T from a position of the upper discharge hole 190T, is formed.

In the upper discharge valve housing recessed part 164T, a whole of a reed valve-type upper discharge valve 200T a rear end part of which is fixed by an upper rivet 202T in the upper discharge valve housing recessed part 164T and a front part of which opens/closes the upper discharge hole 190T, and an upper discharge valve pressor 201T a rear end part of which is placed on the upper discharge valve 200T and fixed by the upper rivet 202T in the upper discharge valve housing recessed part 164T and a front part of which is bent (curved) and controls an aperture of the upper discharge valve 200T, are housed.

In the lower end plate 160S, the lower discharge hole 190S, which pierces through the lower end plate 160S and that communicates with the lower compression chamber 133S of the lower cylinder 121S, is provided. In the lower end plate 160S, a lower discharge valve housing recessed part (not illustrated), which is extended in a groove shape in a circumferential direction of the lower end plate 160S from a position of the lower discharge hole 190S, is formed.

In the lower discharge valve housing recessed part, a whole of a reed valve-type lower discharge valve 200S a rear end part of which is fixed by a lower rivet 202S in the lower discharge valve housing recessed part and a front part of which opens/closes the lower discharge hole 190S, and a lower discharge valve pressor 201S a rear end part of which is placed on the lower discharge valve 200S and fixed by the lower rivet 202S in the lower discharge valve housing recessed part and a front part of which is bent (curved) and controls an aperture of the lower discharge valve 200S, are housed.

An upper end plate cover chamber 180T is formed between the upper end plate 160T and the upper end plate cover 170T having the bulged part 181, the plate and the cover being tightly fixed to each other. A lower end plate cover chamber 180S (see FIG. 1) is formed between the lower end plate 160S and the tabular lower end plate cover 170S that are tightly fixed to each other. A refrigerant passage hole 136, which pierces through the lower end plate 160S, the lower cylinder 121S, the intermediate partition plate 140, the upper end plate 160T, and the upper cylinder 121T and which makes the lower end plate cover chamber 180S and the upper end plate cover chamber 180T communicate with each other, is provided.

In the following, a flow of a refrigerant due to a rotation of the rotating shaft 15 will be described. In the upper cylinder chamber 130T, when the upper piston 125T, which is fitted into the upper eccentric part 152T of the rotating shaft 15, performs an orbital motion along an outer peripheral surface of the upper cylinder chamber 130T (inner peripheral surface of upper cylinder 121T) due to a rotation of the rotating shaft 15, the upper suction chamber 131T sucks a refrigerant from the upper suction pipe 105 while increasing a capacity, and the upper compression chamber 133T compresses the refrigerant while reducing a capacity. When pressure of the compressed refrigerant becomes higher than pressure of the upper end plate cover chamber 180T on an outer side of the upper discharge valve 200T, the upper discharge valve 200T is opened and the refrigerant is discharged from the upper compression chamber 133T to the upper end plate cover chamber 180T. The refrigerant, which is discharged to the upper end plate cover chamber 180T, is discharged from an upper end plate cover discharge hole 172T (see FIG. 1), which is provided in the upper end plate cover 170T, into the compressor housing 10.

Also, in the lower cylinder chamber 130S, when the lower piston 125S, which is fitted into the lower eccentric part 152S of the rotating shaft 15, performs an orbital motion along an outer peripheral surface of the lower cylinder chamber 130S (inner peripheral surface of lower cylinder 121S) due to a rotation of the rotating shaft 15, the lower suction chamber 131S sucks a refrigerant from the lower suction pipe 104 while increasing a capacity, and the lower compression chamber 133S compresses the refrigerant while reducing a capacity. When pressure of the compressed refrigerant becomes higher than pressure of the lower end plate cover chamber 180S on an outer side of the lower discharge valve 200S, the lower discharge valve 200S is opened and the refrigerant is discharged from the lower compression chamber 133S to the lower end plate cover chamber 180S. The refrigerant, which is discharged to the lower end plate cover chamber 180S, passes through the refrigerant passage hole 136 and the upper end plate cover chamber 180T, and is discharged into the compressor housing 10 from the upper end plate cover discharge hole 172T, which is provided in the upper end plate cover 170T.

The refrigerant, which is discharged into the compressor housing 10, is guided to an upper side of the motor 11 through a notch (not illustrated), which is provided in an outer periphery of the stator 111 and which makes an upper and lower sides communicate with each other, a gap (not illustrated) in a winding part of the stator 111, or a gap 115 (see FIG. 1) between the stator 111 and the rotor 112, and is discharged from the discharge pipe 107 arranged as a discharge portion in an upper part of the compressor housing 10.

(Characteristic Configuration of Rotary Compressor)

Figure 4:
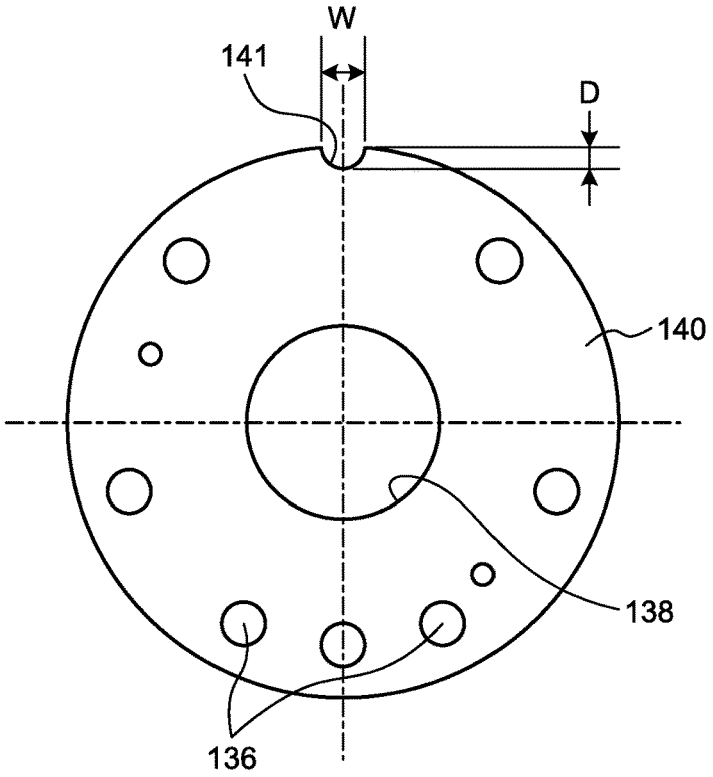
FIG. 4 is a plan view illustrating an intermediate partition plate of the rotary compressor of the embodiment.

Next, a characteristic configuration of the rotary compressor 1 of the embodiment will be described. FIG. 4 is a plan view illustrating the intermediate partition plate 140 of the rotary compressor 1 of the embodiment, and FIG. 5 is a partial perspective view for describing a recessed part in the intermediate partition plate 140 of the rotary compressor 1 of the embodiment.

As illustrated in FIG. 4, a circular through hole 138, through which the rotating shaft 15 passes, is provided in a center of the intermediate partition plate 140. As illustrated in FIG. 4 and FIG. 5, in an outer peripheral part of the intermediate partition plate 140, a recessed part 141, which has an arched cross section, is provided in a position where the upper vane 127T and the lower vane 127S slide. That is, the recessed part 141 is formed in a position, which faces each of the upper vane groove 128T and the lower vane groove 128S, in an end part on an outer peripheral side of the intermediate partition plate 140. Also, the recessed part 141 is formed from one end side to the other end side in a direction of the rotating shaft 15 of the intermediate partition plate 140.

Figure 5:
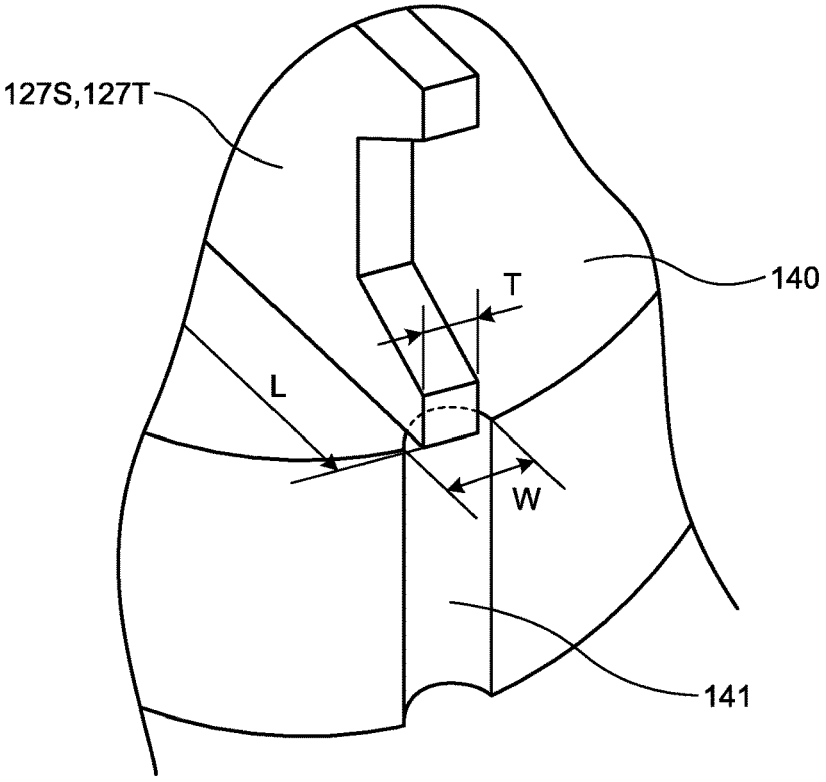
FIG. 5 is a partial perspective view for describing a recessed part of the intermediate partition plate of the rotary compressor of the embodiment.

As illustrated in FIG. 5, a width W of the recessed part 141, in a circumferential direction of the intermediate partition plate 140, is larger than a thicknesses T of each of the upper vane 127T and the lower vane 127S. With this arrangement, the upper vane 127T and the lower vane 127S can advance into the recessed part 141, and an inclination in a sliding direction of the upper vane 127T and the lower vane 127S can be corrected, as described later.

In the present embodiment, 80% or more of entire lengths L in a sliding direction of the upper vane 127T and the lower vane 127S (reciprocation direction with respect to upper cylinder 121T and lower cylinder 121S) are respectively housed, at bottom dead centers of the upper piston 125T and the lower piston 125S, in the upper cylinder 121T and the lower cylinder 121S. In other words, at the bottom dead centers of the upper piston 125T and the lower piston 125S, protruded amounts of the upper vane 127T and the lower vane 127S protruded into the recessed part 141, are respectively smaller than 20% of the entire lengths L of the upper vane 127T and the lower vane 127S.

A depth D of the recessed part 141, in a radial direction of the intermediate partition plate 140, is 10% or more of the entire length L of each of the upper vane 127T and the lower vane 127S. In short, when the depth of the recessed part 141 is D, and the entire length of the upper vane 127T and the lower vane 127S is L, $$D \geq 0.1 \times L \qquad \text{Expression 1}$$

is satisfied.

(Function of Recessed Part in Intermediate Partition Plate)

Figure 6A:
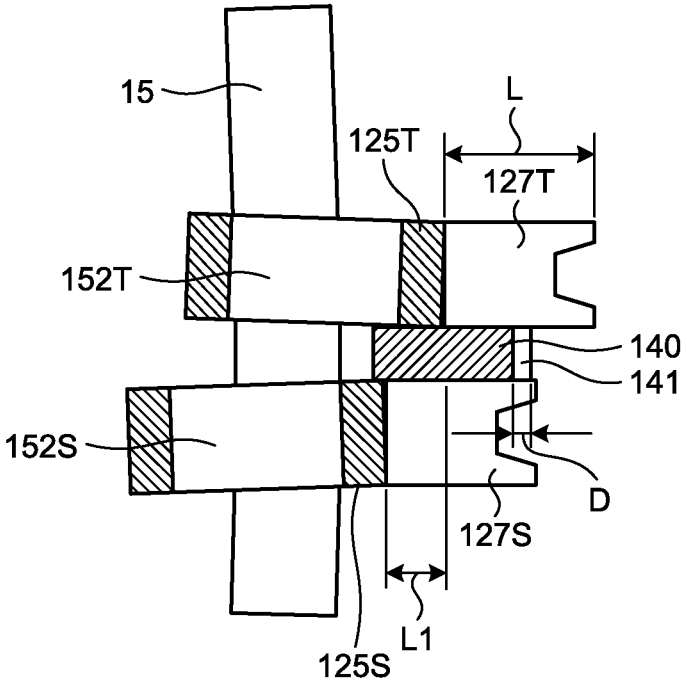
FIG. 6A is a schematic view illustrating a state in which an upper piston and a lower piston are inclined along with a deflection of a rotating shaft in the rotary compressor of the embodiment.
Figure 6B:
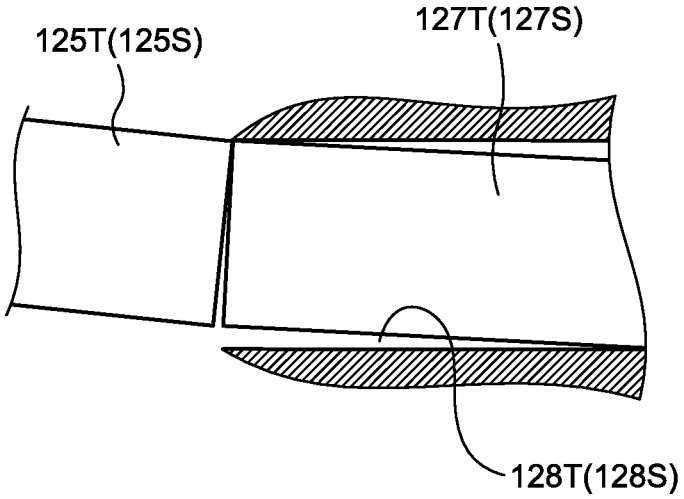
FIG. 6B is a schematic view illustrating a state in which an upper vane is inclined in an upper vane groove in the rotary compressor of the embodiment.

When a refrigerant is compressed by the upper piston 125T and the lower piston 125S in the upper cylinder 121T and the lower cylinder 121S, the rotating shaft 15 is deflected only for a little in an axial direction in the rotary compressor 1. As illustrated in FIG. 6A, the upper piston 125T and the lower piston 125S are inclined in a direction orthogonal to the rotating shaft 15 along with the deflection of the rotating shaft 15. Along with the inclination of the upper piston 125T and the lower piston 125S, the upper vane 127T and the lower vane 127S are inclined in the sliding direction, as illustrated in FIG. 6B, for an amount of a clearance between the upper vane 127T and the upper vane groove 128T and a clearance between the lower vane 127S and the lower vane groove 128S in a vertical direction of the rotary compressor 1 (axial direction of rotating shaft 15). Thus, there is a possibility that a contact state between a leading end of the upper vane 127T and the outer peripheral surface of the upper piston 125T and a contact state between a leading end of the lower vane 127S and the outer peripheral surface of the lower piston 125S vary, and that the leading ends of the upper vane 127T and the lower vane 127S that slide in a state of being held in the upper vane groove 128T and the lower vane groove 128S are brought into a state of being partially in contact with the outer peripheral surfaces of the upper piston 125T and the lower piston 125S respectively.

Figure 6C:
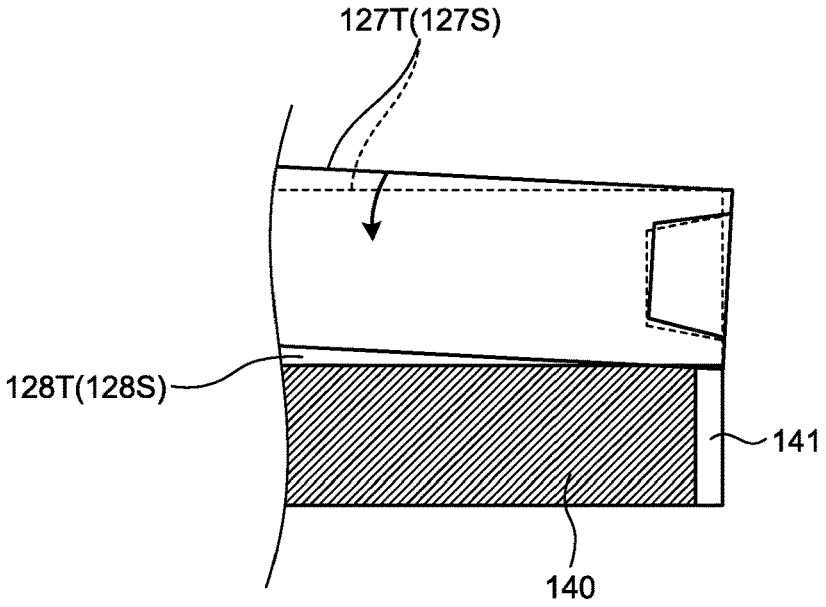
FIG. 6C is a schematic view illustrating a state in which an inclination of the upper vane is corrected by the recessed part of the intermediate partition plate in the rotary compressor of the embodiment.

However, in the present embodiment, even in a case where an inclination is generated in the upper piston 125T, the lower piston 125S, the upper vane 127T, and the lower vane 127S along with the deflection of the rotating shaft 15 as illustrated in FIG. 6B, end parts of the upper vane 127T and the lower vane 127S advance in an inclination state into the recessed part 141 as illustrated in FIG. 6C. Thus, the recessed part 141 functions as clearance (allowance) for the upper vane 127T and the lower vane 127S. Thus, holding force in a height direction of the upper vane 127T and the lower vane 127S that slide in a state of being held in the upper vane groove 128T and the lower vane groove 128S respectively (direction of rotating shaft 15) is reduced, and positions of the upper vane 127T and the lower vane 127S become more likely to vary in the upper vane groove 128T and the lower vane groove 128S. Accordingly, the upper vane 127T (lower vane 127S) is smoothly corrected from an inclination state of when an amount of protrusion into the upper cylinder chamber 130T (into lower cylinder chamber 130S) is small, the state being indicated by a solid line in FIG. 6C, into an appropriate state of when an amount of protrusion into the upper cylinder chamber 130T (into lower cylinder chamber 130S) is large, the state being indicated by a dotted line in FIG. 6C, and the upper vane 127T (lower vane 127S) can be returned to an appropriate sliding state. In the recessed part 141 in the intermediate partition plate 140, an inclination correction function for the upper vane 127T and the lower vane 127S in the height direction can be appropriately acquired when the depth D satisfies the above expression 1. Note that in FIGS. 6B and 6C, an inclination state of the upper vane 127T in the upper vane groove 128T along with an inclination of the upper piston 125T is illustrated. However, an inclination state of the lower vane 127S in the lower vane groove 128S along with an inclination of the lower piston 125S is in a similar manner.

A case where the depth D of the recessed part 141 is smaller than 10% of the entire length L of each of the upper vane 127T and the lower vane 127S is not preferable since the depth D is not adequate and a function of correcting an inclination state of the upper vane 127T and the lower vane 127S is poor.

Also, when the thickness of the intermediate partition plate 140 is cut and processed, the recessed part 141 is used as a positioning recessed part into which a positioning pin to determine a position of the intermediate partition plate 140 with respect to a processing tool is fitted. Thus, in the present embodiment, by using the positioning recessed part as the recessed part 141 to correct an inclination of the upper vane 127T and the lower vane 127S, it is not necessary to additionally process the recessed part 141 in the outer peripheral part of the intermediate partition plate 140 and an increase in a production cost of the rotary compressor 1 is controlled.

Also, the recessed part 141 is formed as a part of an outer shape of the intermediate partition plate 140 when the intermediate partition plate 140 is casted. Thus, in the recessed part 141, a draft taper for a removal of the intermediate partition plate 140 from a forming mold during casting of the intermediate partition plate 140 is provided. More specifically, the recessed part 141 is formed in a tapered shape (with draft angle) in which the depth D in the radial direction of the intermediate partition plate 140 becomes gradually smaller from one end side toward the other end side, in the direction of the rotating shaft 15, of the intermediate partition plate 140. Accordingly, the intermediate partition plate 140 can be taken out from the forming mold during casting. In the present embodiment, a taper is included since such a recessed part 141 is used as the recessed part 141 to correct an inclination of the upper vane 127T and the lower vane 127S. Thus, the depth D of the recessed part 141 at the other end of the intermediate partition plate 140 also satisfies the above expression 1.

Effect of Embodiment

As described above, in an outer peripheral part of the intermediate partition plate 140 in the rotary compressor 1 of the embodiment, the recessed part 141 is provided in a position where the upper vane 127T and the lower vane 127S slide, and 80% or more of the entire lengths in the sliding direction of the upper vane 127T and the lower vane 127S are respectively housed, at the bottom dead centers of the upper piston 125T and the lower piston 125S, in the upper cylinder 121T and the lower cylinder 121S. When the depth of the recessed part 141 is D and the entire length of each of the upper vane 127T and the lower vane 127S is L, $D \geq 0.1 \times L$ . . . Expression 1 is satisfied. Accordingly, generation of partial contact between the upper vane 127T and the upper piston 125T, and partial contact between the lower vane 127S and the lower piston 125S is controlled, and abrasion or breakage of the upper vane 127T, the lower vane 127S, the upper piston 125T, and the lower piston 125S can be controlled. Thus, operation reliability of the upper vane 127T and the lower vane 127S can be improved.

Also, in the rotary compressor 1 of the embodiment, a positioning recessed part for processing of the intermediate partition plate 140 is used as the recessed part 141 to correct an inclination of the upper vane 127T and the lower vane 127S. Thus, it is not necessary to additionally process the recessed part 141 in the outer peripheral part of the intermediate partition plate 140, and it is possible to control an increase in a production cost of the rotary compressor 1.

Figure 7:
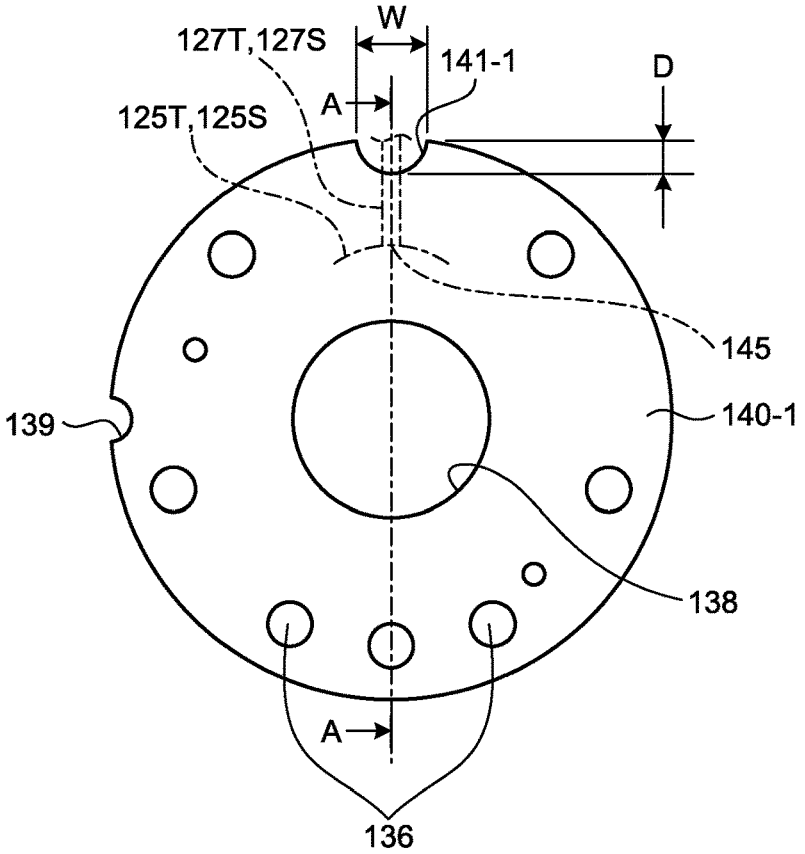
FIG. 7 is a plan view illustrating an intermediate partition plate of a rotary compressor of a modification example.

In the following, an intermediate partition plate in a modification example will be described with reference to the drawings. For convenience, in the modification example, a sign that is the same as that of the embodiment is assigned to a part identical to the embodiment and a description thereof is omitted. FIG. 7 is a plan view illustrating an intermediate partition plate of a rotary compressor of a modification example.

As illustrated in FIG. 7, an intermediate partition plate 140-1 in the modification example is different from the intermediate partition plate 140 in the embodiment in a point that a recessed part 141-1 to correct an inclination of an upper vane 127T and a lower vane 127S is formed by cutting processing in addition to a positioning recessed part 139 used for processing in the above-described manner. The recessed part 141-1 is provided in an outer peripheral part of the intermediate partition plate 140-1 which part corresponds to a position where the upper vane 127T and the lower vane 127S slide.

The recessed part 141-1 is formed in such a manner that an outer peripheral surface of the intermediate partition plate 140-1 is notched to have an arc-shaped cross section in a cross section orthogonal to an axial direction of a rotating shaft 15. The recessed part 141-1 is formed from one end side to the other end side, in the axial direction of the rotating shaft 15, of the intermediate partition plate 140-1. Also, the recessed part 141-1 is formed in a position deviated for 90° around a center of a through hole 138 of the intermediate partition plate 140-1 with respect to a position of the positioning recessed part 139.

The recessed part 141-1 in the modification example is formed by cutting processing with a cutting tool such as an end mill or a drill. Thus, compared to the positioning recessed part 139 having a casting surface in casting of the intermediate partition plate 140-1, surface roughness on a surface of an inner surface of the recessed part 141-1 is small and the surface of the recessed part 141-1 is formed smoothly. In a case where a positioning recessed part 139 having a casting surface is used as a recessed part 141 in a manner of the above-described embodiment, there is a possibility that the casting surface is peeled off by pressing force applied in advancing of end parts of the upper vane 127T and the lower vane 127S into the recessed part 141 (positioning recessed part 139), and there is a possibility that breakage of the recessed part 141 is caused or sliding of the upper vane 127T and the lower vane 127S is prevented by a piece peeled off. On the one hand, since the recessed part 141-1 on which cutting processing is performed is included, a surface of the recessed part 141-1 become smooth in the modification example. Thus, peeling or breakage of the surface of the recessed part 141-1 is controlled, and reliability in a sliding operation of the upper vane 127T and the lower vane 127S is improved.

Note that the recessed part 141-1 is formed by cutting processing in the modification example. However, for example, when an intermediate partition plate 140-1 is formed by sintering, a surface of a positioning recessed part 139 is formed smoothly compared to a casting surface in casting. Thus, the positioning recessed part 139 can be used as a recessed part 141 similarly to the above-described embodiment. With the positioning recessed part 139 formed by sintering, peeling of a surface in utilization as a recessed part 141 is controlled compared to a case of a positioning recessed part 139 formed by casting.

In addition, the recessed part 141-1 in the modification example is formed by cutting processing in a thickness direction of the intermediate partition plate 140-1 (axial direction of rotating shaft 15). Thus, a draft angle is not included in the thickness direction of the intermediate partition plate 140-1 unlike the positioning recessed part 139. In a case where a positioning recessed part 139 having a draft angle is used as a recessed part 141, a depth D of the recessed part 141 is different on both sides in the thickness direction of the intermediate partition plate 140. Thus, there is a possibility that a difference is generated between a function of correcting an inclination in the upper vane 127T and a function of correcting an inclination in the lower vane 127S, and that a difference is generated in an effect of controlling partial contact between an upper piston 125T and a lower piston 125S.

On the one hand, the recessed part 141-1 in the modification example is formed with a depth D being even from one end side to the other end side of the intermediate partition plate 140-1 in the axial direction of the rotating shaft 15. Thus, in the modification example, since there is no difference in the depth D of the recessed part 141-1 on both sides in the thickness direction of the intermediate partition plate 140-1, generation of a difference between the function of correcting an inclination in the upper vane 127T and the function of correcting an inclination in the lower vane 127S is controlled, and generation of a difference between an effect of controlling partial contact in the upper vane 127T and the upper piston 125T and an effect of controlling partial contact in the lower vane 127S and the lower piston 125S is controlled.

Also, in the modification example, double of an eccentric amount of an upper eccentric part 152T of the rotating shaft 15 is 30% or more of an entire length L in a sliding direction of the upper vane 127T. Similarly, double of an eccentric amount of a lower eccentric part 152S of the rotating shaft 15 is 30% or more of an entire length L in a sliding direction of the lower vane 127S. In other words, at bottom dead centers of the upper piston 125T and the lower piston 125S, 30% or more of the entire lengths L in the sliding direction of the upper vane 127T and that of the lower vane 127S are respectively protruded from the upper vane groove 128T into the upper cylinder chamber 130T and from the lower vane groove 128S into the lower cylinder chamber 130S. Also, in the recessed part 141-1 in the intermediate partition plate 140-1, the above-described expression 1 is satisfied similarly to the recessed part 141 in the embodiment.

Also, as illustrated in FIG. 7, a coated membrane 145 is formed at a leading end part of each of the upper vane 127T and the lower vane 127S in the modification example, and abrasion of outer peripheral surfaces of the upper piston 125T and the lower piston 125S, on which the leading end parts of the upper vane 127T and the lower vane 127S slide, is controlled with the coated membrane 145. For example, the coated membrane 145 includes any of diamond-like carbon (DLC), a chromium nitride (CrN), and a titanium nitride (TiN). The coated membrane 145 is not limited to have one layer. For example, a plurality of coated membranes 145 including a ground layer provided between an upper vane 127T (lower vane 127S) and a DLC film, and a fitting layer that further covers the DLC film may be formed.

In the modification example, since the recessed part 141-1 is included, partial contact between the upper vane 127T and the upper piston 125T, and partial contact between the lower vane 127S and the lower piston 125S are controlled. Thus, peeling or breakage of the coated membrane 145 is controlled. As a result, the effect of controlling abrasion of the outer peripheral surfaces of the upper piston 125T and the lower piston 125S can be improved with the coated membrane 145.

Figure 8A:
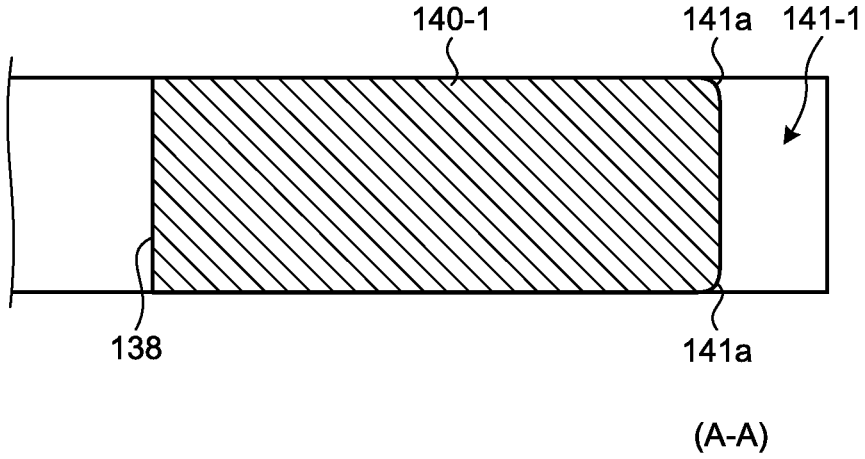
FIG. 8A is a sectional view in an A-A line in FIG. 7, illustrating a chamfered face included in a recessed part of the intermediate partition plate in the modification example.
Figure 8B:
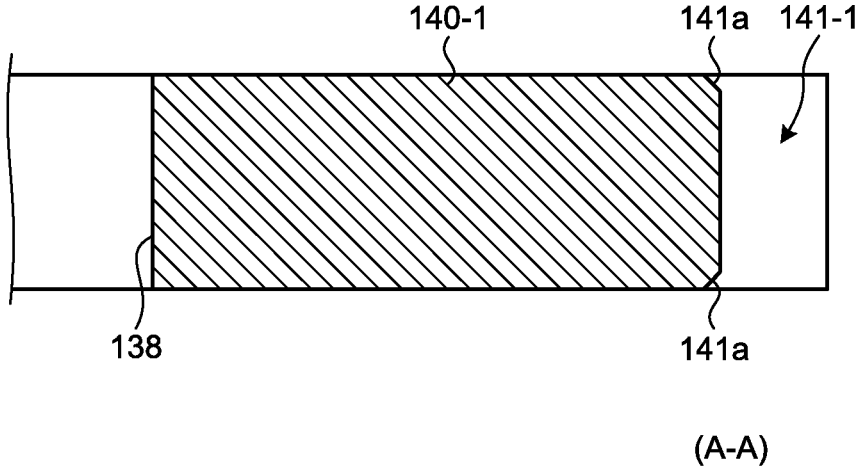
FIG. 8B is a sectional view in the A-A line in FIG. 7, illustrating a different chamfered face included in the recessed part of the intermediate partition plate in the modification example.

FIG. 8A is a sectional view in an A-A line in FIG. 7, illustrating a chamfered face included in the recessed part 141-1 in the intermediate partition plate 140-1 in the modification example. FIG. 8B is a sectional view in the A-A line in FIG. 7, illustrating a different chamfered face included in the recessed part 141-1 in the intermediate partition plate 140-1 in the modification example.

As illustrated in FIG. 8A and FIG. 8B, in the recessed part 141-1 in the intermediate partition plate 140-1, a chamfered face 141*a* is formed at each corner between a face on which the upper vane 127T slides in the intermediate partition plate 140-1 and an inner surface of the recessed part 141-1. Similarly, in the recessed part 141-1, a chamfered face 141*a* is formed at a corner between a face on which the lower vane 127S slides in the intermediate partition plate 140-1 and the inner surface of the recessed part 141-1. As the chamfered face, an R-chamfered face having a predetermined curvature radius may be formed as illustrated in FIG. 8A, or a C-chamfered face that is inclined with respect to the sliding face on the intermediate partition plate 140-1 may be formed as illustrated in FIG. 8B. Since the recessed part 141-1 has the chamfered face 141*a*, base end parts on a side of the recessed part 141-1 in the sliding direction of the upper vane 127T and the lower vane 127S more easily advance into the recessed part 141-1, and a function of correcting an inclination in the upper vane 127T and the lower vane 127S is improved. Also, since the chamfered face 141*a* is included, breakage of the above-described corner in the recessed part 141-1 can be controlled.

Note that although not illustrated, in a part of the base end parts on the side of the recessed part 141-1 in the sliding direction of the upper vane 127T and the lower vane 127S, an inclination face or a chamfered face that is inclined slightly with respect to the sliding face of the intermediate partition plate 140-1 may be formed. Accordingly, the base end parts in the sliding direction of the upper vane 127T and the lower vane 127S more easily advance into the recessed part 141-1, and a correcting function for an inclination in the upper vane 127T and the lower vane 127S is further improved.

As described above, in an outer peripheral part of the intermediate partition plate 140-1 in the modification example, the recessed part 141-1 is provided in a position where the upper vane 127T and the lower vane 127S slide, and double of the eccentric amounts of the upper eccentric part 152T and the lower eccentric part 152S of the rotating shaft 15 is 30% or more of the entire lengths in the sliding direction of the upper vane 127T and the lower vane 127S respectively. When the depth of the recessed part 141 is D and the entire length of each of the upper vane 127T and the lower vane 127S is L, $D \geq 0.1 \times L$ . . . Expression 1 is satisfied. Accordingly, similarly to the embodiment, generation of partial contact between the upper vane 127T and the upper piston 125T, and partial contact between the lower vane 127S and the lower piston 125S is controlled, and abrasion or breakage of the upper vane 127T, the lower vane 127S, the upper piston 125T, and the lower piston 125S can be controlled. Thus, operation reliability of the upper vane 127T and the lower vane 127S can be improved.

Also, in the upper vane 127T and the lower vane 127S in the modification example, the coated membrane 145 including any one of diamond-like carbon, a chromium nitride, and a titanium nitride is provided at each of leading end parts that respectively come into contact with on the upper piston 125T and the lower piston 125S. According to the modification example, generation of partial contact between the upper vane 127T and the upper piston 125T, and partial contact between the lower vane 127S and the lower piston 125S can be controlled. Thus, it becomes possible to control pealing or breakage of the coated membrane 145, and it is possible to improve an effect of controlling abrasion of the outer peripheral surfaces of the upper piston 125T and the lower piston 125S with the coated membrane 145.

Also, the recessed part 141-1 in the modification example is formed from one end side to the other end side of the intermediate partition plate 140-1 in the axial direction of the rotating shaft 15. Accordingly, when the recessed part 141-1 is processed with a cutting tool such as an end mill, a recessed part for the upper vane 127T and a recessed part for the lower vane 127S are processed collectively, whereby processing a property can be improved.

Also, the recessed part 141-1 in the modification example is formed with the depth D being even from one end side to the other end side of the intermediate partition plate 140-1 in the axial direction of the rotating shaft 15. With this arrangement, the depth D of the recessed part 141-1 on the side of the upper vane 127T and the depth D of the recessed part 141-1 on the side of the lower vane 127S are equal. Thus, an effect of controlling partial contact between the upper vane 127T and the upper piston 125T and an effect of controlling generation of partial contact between the lower vane 127S and the lower piston 125S can be secured equally.

Also, in the recessed part 141-1 in the modification example, the chamfered face 141*a* is formed at each of corners between faces, on which the upper vane 127T and the lower vane 127S slide respectively, in the intermediate partition plate 140-1 and the inner surface of the recessed part 141-1. With this arrangement, the upper vane 127T and the lower vane 127S more easily advance into the recessed part 141-1. Thus, the effect of correcting an inclination in the upper vane 127T and the lower vane 127S can be improved.

Also, the recessed part 141-1 in the modification example is formed in such a manner that an outer peripheral surface of the intermediate partition plate 140-1 is notched in an arc shape in a cross section orthogonal to the axial direction of the rotating shaft 15. Accordingly, it is possible to easily process the recessed part 141-1 by using a cutting tool such as an end mill.

Although an embodiment has been described in the above, an embodiment is not limited by the above-described contents. Also, the above-described configuration elements include what can be easily assumed by those skilled in the art, what is substantially identical, and what is in a so-called equivalent range. Moreover, the above-described configuration elements can be arbitrarily combined. Moreover, at least one of various kinds of omission, replacement, and modification of a configuration element can be performed within the spirit and the scope of an embodiment.

REFERENCE SIGNS LIST

1 rotary compressor
10 compressor housing
11 motor
12 compressing unit
15 rotating shaft
25 accumulator
104 lower suction pipe
105 upper suction pipe
107 discharge pipe
111 stator
112 rotor
121T upper cylinder
121S lower cylinder
122T upper side protrusion part
122S lower side protrusion part
123T upper cylinder inner wall
123S lower cylinder inner wall
125T upper piston
125S lower piston
127T upper vane
127S lower vane
128T upper vane groove
128S lower vane groove
130T upper cylinder chamber
130S lower cylinder chamber
131T upper suction chamber
131S lower suction chamber
133T upper compression chamber
133S lower compression chamber
135T upper suction hole
135S lower suction hole
136 refrigerant passage hole
140-1 intermediate partition plate
141-1 recessed part
141*a* chamfered face
145 coated membrane
151 sub-shaft part
152T upper eccentric part
152S lower eccentric part
153 main shaft part
160T upper end plate
160S lower end plate
161T main baring part
161S sub bearing part
D depth
L entire length
T thickness
W width

The invention claimed is:

1. A rotary compressor comprising:

a vertically-cylindrical compressor housing in an upper part of which a discharge portion for a refrigerant is provided and in a lower part of which a suction portion for the refrigerant is provided;

a compressing unit that is arranged in the lower part in the compressor housing, that compresses the refrigerant sucked from the suction portion, and that performs a discharge thereof from the discharge portion; and a motor that is arranged in the upper part in the compressor housing and that drives the compressing unit, wherein the compressing unit includes an annular upper cylinder and an annular lower cylinder, an upper end plate that blocks an upper side of the upper cylinder, a lower end plate that blocks a lower side of the lower cylinder, an intermediate partition plate that is arranged between the upper cylinder and the lower cylinder and that blocks a lower side of the upper cylinder and an upper side of the lower cylinder, a rotating shaft rotated by the motor, an upper eccentric part and a lower eccentric part that are provided to the rotating shaft with 180° of a phase difference from each other, an upper piston that is fitted into the upper eccentric part, that makes an orbit motion along an inner peripheral surface of the upper cylinder, and that forms an upper cylinder chamber in the upper cylinder, a lower piston that is fitted into the lower eccentric part, that makes an orbit motion along an inner peripheral surface of the lower cylinder, and that forms a lower cylinder chamber in the lower cylinder, an upper vane that separates the upper cylinder chamber into an upper suction chamber and an upper compression chamber by being protruded from an upper vane groove provided in the upper cylinder into the upper cylinder chamber and coming into contact with the upper piston, and a lower vane that separates the lower cylinder chamber into a lower suction chamber and a lower compression chamber by being protruded from a lower vane groove provided in the lower cylinder into the lower cylinder chamber and coming into contact with the lower piston, a recessed part is provided in a position, in which the upper vane and the lower vane slide, in an outer peripheral part of the intermediate partition plate, double of eccentric amounts of the upper eccentric part and the lower eccentric part of the rotating shaft is 30% or more of entire lengths in a sliding direction of the upper vane and the lower vane respectively, and a width W of the recessed part in a circumferential direction of the intermediate partition plate is larger than a thickness T of each of the upper vane and the lower vane, and when a depth of the recessed part is D and the entire length of each of the upper vane and the lower vane is L, $$D \geq 0.1 \times L \qquad \text{Expression 1}$$

is satisfied.

2. The rotary compressor according to claim 1, wherein at bottom dead centers of the upper piston and the lower piston, 80% or more of the entire lengths in the sliding direction of the upper vane and the lower vane are respectively housed in the upper cylinder and the lower cylinder.

3. The rotary compressor according to claim 1, wherein a coated membrane is provided at a leading end part of the upper vane which part comes into contact with the upper piston, the coated membrane is provided at a leading end part of the lower vane which part comes into contact with the lower piston, and the coated membrane includes any one of diamond-like carbon, a chromium nitride, and a titanium nitride.

4. The rotary compressor according to claim 1, wherein the recessed part is formed from one end side to the other end side of the intermediate partition plate in an axial direction of the rotating shaft.

5. The rotary compressor according to claim 4, wherein the recessed part is formed from the one end side to the other end side of the intermediate partition plate with the depth D being even.

6. A rotary compressor comprising:

a vertically-cylindrical compressor housing in an upper part of which a discharge portion for a refrigerant is provided and in a lower part of which a suction portion for the refrigerant is provided;

a compressing unit that is arranged in the lower part in the compressor housing, that compresses the refrigerant sucked from the suction portion, and that performs a discharge thereof from the discharge portion; and a motor that is arranged in the upper part in the compressor housing and that drives the compressing unit, wherein the compressing unit includes an annular upper cylinder and an annular lower cylinder, an upper end plate that blocks an upper side of the upper cylinder, a lower end plate that blocks a lower side of the lower cylinder, an intermediate partition plate that is arranged between the upper cylinder and the lower cylinder and that blocks a lower side of the upper cylinder and an upper side of the lower cylinder, a rotating shaft rotated by the motor, an upper eccentric part and a lower eccentric part that are provided to the rotating shaft with 180° of a phase difference from each other, an upper piston that is fitted into the upper eccentric part, that makes an orbit motion along an inner peripheral surface of the upper cylinder, and that forms an upper cylinder chamber in the upper cylinder, a lower piston that is fitted into the lower eccentric part, that makes an orbit motion along an inner peripheral surface of the lower cylinder, and that forms a lower cylinder chamber in the lower cylinder, an upper vane that separates the upper cylinder chamber into an upper suction chamber and an upper compression chamber by being protruded from an upper vane groove provided in the upper cylinder into the upper cylinder chamber and coming into contact with the upper piston, and a lower vane that separates the lower cylinder chamber into a lower suction chamber and a lower compression chamber by being protruded from a lower vane groove provided in the lower cylinder into the lower cylinder chamber and coming into contact with the lower piston, a recessed part is provided in a position, in which the upper vane and the lower vane slide, in an outer peripheral part of the intermediate partition plate, double of eccentric amounts of the upper eccentric part and the lower eccentric part of the rotating shaft is 30% or more of entire lengths in a sliding direction of the upper vane and the lower vane respectively, and a width W of the recessed part in a circumferential direction of the intermediate partition plate is larger than a thickness T of each of the upper vane and the lower vane, and when a depth of the recessed part is D and the entire length of each of the upper vane and the lower vane is L, $$D \geq 0.1 \times L \quad \text{Expression 1}$$

is satisfied, wherein in the recessed part, a chamfered face is formed at each of a corner between a face, on which the upper vane slides, in the intermediate partition plate and an inner surface of the recessed part and a corner between a face, on which the lower vane slides, in the intermediate partition plate and the inner surface of the recessed part.

7. A rotary compressor comprising:

a vertically-cylindrical compressor housing in an upper part of which a discharge portion for a refrigerant is provided and in a lower part of which a suction portion for the refrigerant is provided;

a compressing unit that is arranged in the lower part in the compressor housing, that compresses the refrigerant sucked from the suction portion, and that performs a discharge thereof from the discharge portion; and a motor that is arranged in the upper part in the compressor housing and that drives the compressing unit, wherein the compressing unit includes an annular upper cylinder and an annular lower cylinder, an upper end plate that blocks an upper side of the upper cylinder, a lower end plate that blocks a lower side of the lower cylinder, an intermediate partition plate that is arranged between the upper cylinder and the lower cylinder and that blocks a lower side of the upper cylinder and an upper side of the lower cylinder, a rotating shaft rotated by the motor, an upper eccentric part and a lower eccentric part that are provided to the rotating shaft with 180° of a phase difference from each other, an upper piston that is fitted into the upper eccentric part, that makes an orbit motion along an inner peripheral surface of the upper cylinder, and that forms an upper cylinder chamber in the upper cylinder, a lower piston that is fitted into the lower eccentric part, that makes an orbit motion along an inner peripheral surface of the lower cylinder, and that forms a lower cylinder chamber in the lower cylinder, an upper vane that separates the upper cylinder chamber into an upper suction chamber and an upper compression chamber by being protruded from an upper vane groove provided in the upper cylinder into the upper cylinder chamber and coming into contact with the upper piston, and a lower vane that separates the lower cylinder chamber into a lower suction chamber and a lower compression chamber by being protruded from a lower vane groove provided in the lower cylinder into the lower cylinder chamber and coming into contact with the lower piston, a recessed part is provided in a position, in which the upper vane and the lower vane slide, in an outer peripheral part of the intermediate partition plate, double of eccentric amounts of the upper eccentric part and the lower eccentric part of the rotating shaft is 30% or more of entire lengths in a sliding direction of the upper vane and the lower vane respectively, and a width W of the recessed part in a circumferential direction of the intermediate partition plate is larger than a thickness T of each of the upper vane and the lower vane, and when a depth of the recessed part is D and the entire length of each of the upper vane and the lower vane is L, $$D \geq 0.1 \times L \quad \text{Expression 1}$$

is satisfied, wherein the recessed part is formed in such a manner that an outer peripheral surface of the intermediate partition plate is notched in an arc shape in a cross section orthogonal to an axial direction of the rotating shaft.

* * * * *